US006263510B1

(12) United States Patent
Bay et al.

(10) Patent No.: US 6,263,510 B1
(45) Date of Patent: Jul. 24, 2001

(54) VENTILATING GARMENT

(75) Inventors: Marc A. Bay, Oak Park, MI (US); Bruce T. Parker, Windsor, CA (US)

(73) Assignee: Marco Distributing, Inc., Idaho Falls, ID (US)

( * ) Notice: Subject to any disclaimer, the term of this patent is extended or adjusted under 35 U.S.C. 154(b) by 0 days.

(21) Appl. No.: 09/573,802

(22) Filed: May 18, 2000

(51) Int. Cl.[7] ..... A41D 1/00
(52) U.S. Cl. ..... 2/93; 2/69; 2/108; 2/DIG. 1
(58) Field of Search ..... 2/93, 69, 69.5, 2/82, 85, 87, 94, 115, 79, 108, DIG. 1, 97, 247, 252

(56) References Cited

U.S. PATENT DOCUMENTS

| | | | | |
|---|---|---|---|---|
| 1,015,231 | | 1/1912 | Jacobs . | |
| 1,164,386 | | 12/1915 | Nicholas . | |
| 1,223,863 | | 4/1917 | Freedman . | |
| 1,363,981 | | 12/1920 | Jenkins et al. . | |
| 1,721,403 | | 7/1929 | Milleer . | |
| 1,818,811 | | 8/1931 | Miller . | |
| 2,073,711 | | 3/1937 | Robinsohn . | |
| 2,458,004 | | 1/1949 | Kerr . | |
| 3,045,243 | * | 7/1962 | Lash et al. | 2/DIG. 1 |
| 3,153,793 | * | 10/1964 | Lepore | 2/93 |
| 3,801,987 | | 4/1974 | Thompson, Jr. . | |
| 4,286,337 | | 9/1981 | Malouf, Jr. . | |
| 4,384,369 | | 5/1983 | Prince . | |
| 4,513,451 | | 4/1985 | Brown . | |
| 4,608,715 | | 9/1986 | Miller et al. . | |
| 4,722,099 | | 2/1988 | Kratz . | |
| 4,731,883 | | 3/1988 | Foster . | |
| 5,031,244 | | 7/1991 | Inagaki . | |
| 5,105,477 | | 4/1992 | Golde . | |
| 5,507,042 | * | 4/1996 | Van Der Slessen | 2/69 |
| 5,642,526 | | 7/1997 | Thompson . | |
| 5,704,064 | | 1/1998 | van de Sleesen . | |
| 5,845,336 | | 12/1998 | Golde . | |
| 6,070,274 | * | 6/2000 | Van Der Slessen | 2/456 |

FOREIGN PATENT DOCUMENTS

| | | |
|---|---|---|
| 1029851 | 6/1953 | (FR) . |

OTHER PUBLICATIONS

Accessories Collection, Specialty Sports Limited, http:www-w.tecknicgear.com/main_r1.htm, 4 pp. Apr. 26, 2000.

* cited by examiner

*Primary Examiner*—John J. Calvert
*Assistant Examiner*—Tejash Patel
(74) *Attorney, Agent, or Firm*—Harness, Dickey & Pierce, P.L.C.

(57) ABSTRACT

A ventilating garment having a shell layer and a mid-liner layer is provided. A vent opening is located on both the shell and the mid-liner. The air flows from the first vent opening to the second vent opening, thereby reaching the body of the wearer. The vent opening generally extends from the torso portion and onto the sleeve portion of the garment. The garment is also provided with a flap member that can be deformed from a closed position to a open position to allow air access to the vent opening. To maintain the flap in an open position, a metallic strip is provided inside the flap.

39 Claims, 7 Drawing Sheets

VENTILATING GARMENT

BACKGROUND AND SUMMARY OF THE INVENTION

The present invention relates generally to a garment and more specifically to a garment having vent openings to allow air to reach the body of the wearer.

It is common in the garment industry, particularly in garments that are used by motorcycle riders, to have vent openings to cool the body of the rider in hot weather conditions. Consequently, garments and coats with provisions for ventilation have been developed. Examples of such garments are seen in U.S. Pat. No. 4,608,715, issued Sep. 2, 1986 to Miller et al.; U.S. Pat. No. 5,105,477, issued Apr. 21, 1992 to Golde; and U.S. Pat. No. 5,704,064, issued Jan. 6, 1998 to van der Slessen; these are all incorporated herein by reference.

Various conventional garments also provide protection in bad weather conditions such as rain or sleet. Furthermore, some traditional garments have been developed which provide both rain protection and ventilation. For example, U.S. Pat. No. 5,845,336, issued Dec. 8, 1998 to Golde, discloses a protective and ventilating garment intended to be worn by a motorcycle rider. This garment, however, does not have any provision for the cool air to reach the body of the rider since the vent opening is provided in the outer layer of the garment. Moreover, the garment disclosed in the '336 patent does not prevent the rain protection flap from covering the vent opening in windy conditions or during normal high speed motorcycle use.

Since motorcycle, all terrain vehicles, or other motorsport riders primarily wear these general types of garments, it is also known to provide internal protective "body armor" at the shoulder, back, and elbows. Conventional jacket type garments have further employed a vent in the back of an outer shell.

In accordance with the present invention, a preferred embodiment of a ventilating garment has an outer shell and a mid-liner with vent openings. In another aspect of the present invention, the vents on the shell and the mid-liner coordinate with each other such that air entering the vent from the shell exits through the vent in the mid-liner, thereby reaching the body of the wearer. A further aspect of the present invention provides closure mechanisms, which open or close the vent openings. Still another aspect of the present invention employs vent openings with a mesh material to deter insects or other particles from entering the garment. In yet another aspect of the present invention, protective reinforcements are provided at the elbow, shoulder, and/or back of the garment. Another aspect of the present invention provides an upper and lower flap around a vent opening to deter water from entering the garment in wet weather conditions. In another aspect of the present invention, a flap member can be deformed from a closed position to an open position and allow air access. For the vent to maintain the open position of the flap, a metallic strip is inserted inside the flap. Another aspect of the present invention employs a vent opening which generally extends from the torso portion and onto the sleeve portion of the garment across the traditional seam location between the torso and the sleeve.

The ventilating garment of the present invention is advantageous over previously designed garments in that the present invention allows the air to reach the body of the wearer without becoming significantly trapped inside the shell or the mid-liner. Thus, the present invention deters ballooning effects in the garment while riding at high speed.

Moreover, the present invention advantageously maintains the rain protection flap in a raised and open orientation to allow air access to the vent opening in windy conditions and high speed use by providing a deformable member inside the flap. To further assist in maintaining the flap and vent in an open condition, the vent opening is located across both the torso portion and the sleeve portion to take advantage of the posture of the wearer while riding a motorcycle. Additional advantages and features of the present invention will become apparent from the following description and appended claims, taken in conjunction with the accompanying drawings.

DETAILED DESCRIPTION OF THE PREFERRED EMBODIMENT

Figure 1:
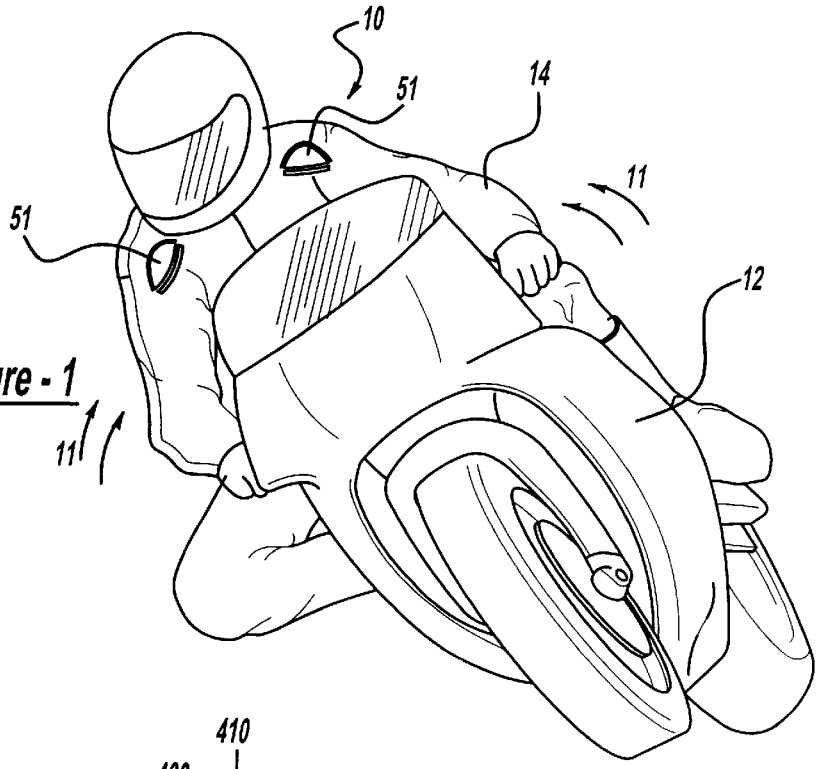
FIG. 1 is a perspective view showing the preferred embodiment of the garment of the present invention, used by a rider on a motorcycle.

Referring to FIG. 1, a motorcycle rider 10 is shown riding a motorcycle 12 and is subjected to a moving airstream indicated by arrows 11 against the front of the rider's body. The rider is wearing a ventilating garment 14, preferably a jacket, covering his arms and torso.

Figure 2:
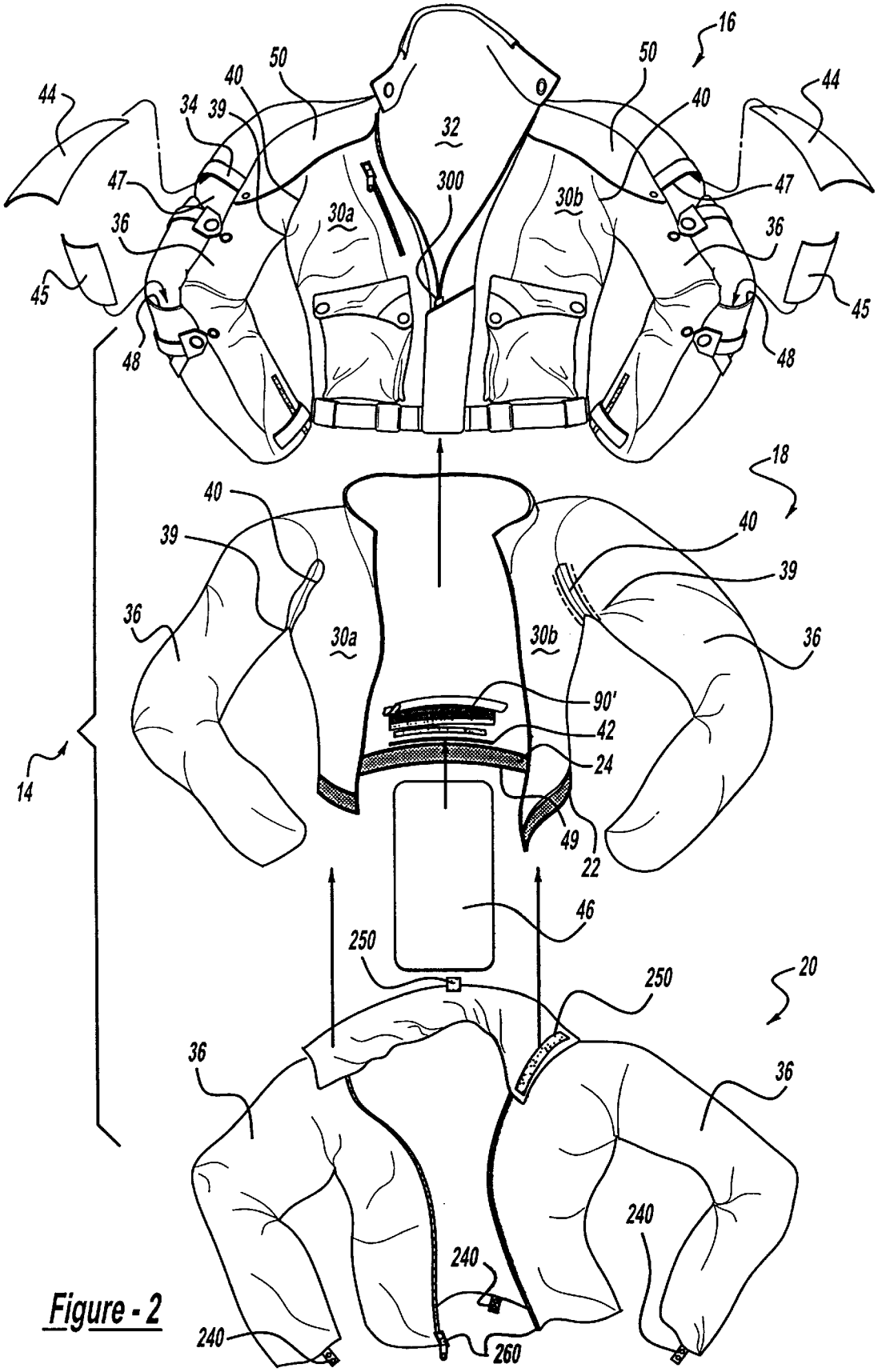
FIG. 2 is an exploded front view showing the preferred embodiment garment.
Figure 3:
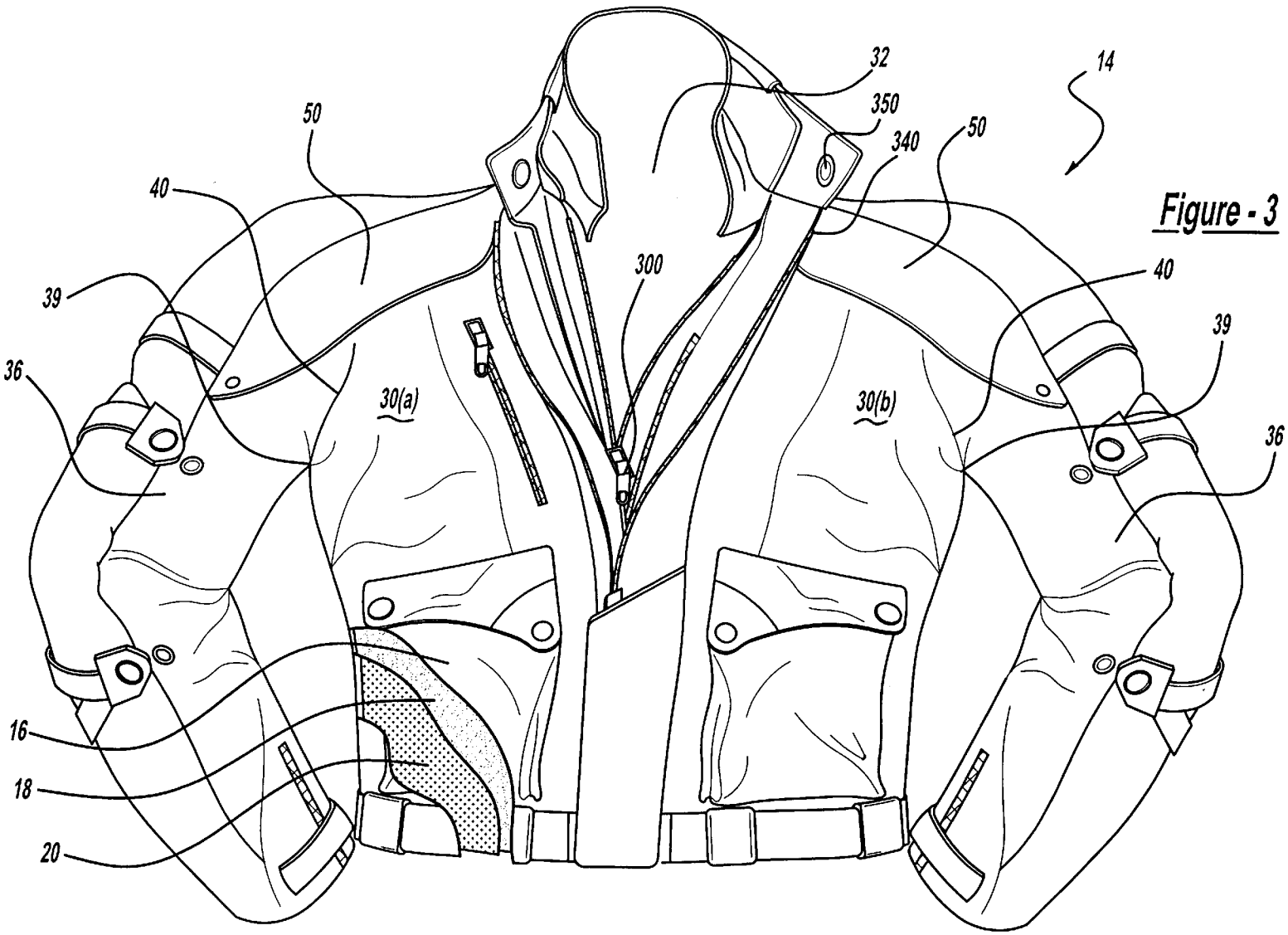
FIG. 3 is a partially fragmented front view of the preferred embodiment garment showing front vents in closed orientations.

As can be observed in FIGS. 2 and 3, the preferred embodiment of the ventilating garment 14 of the present invention includes an outer shell 16, a mid-liner 18, and may optionally have an additional insulating liner 20. Shell 16 and mid-liner 18 are sewn together at the lower end of garment 22. In order to provide better ventilation, the lower end of mid-liner 18 is attached to a mesh material 24, by sewn stitching or the like. Mesh material is generally non-stretchable and has oval shaped openings with about a 3/32-inch diameter. Shell 16 is preferably made of a predominately waterproof material such as 600 denier, woven polyester, but may alternately be Taslen brand nylon. Mid-liner 18 is preferably made of a lightweight material such as a polyurethane coated, nylon fabric. Outer shell 16 is made of a heavier weight and denser material than mid-liner 18. Insulating liner 20 is removably attached from shell 16 by snaps 240, hook and loop strips 250, and zipper attachments 260. Insulating layer 20 is attached closest to the user's body 200, internal to mid-liner 18.

Figure 4:
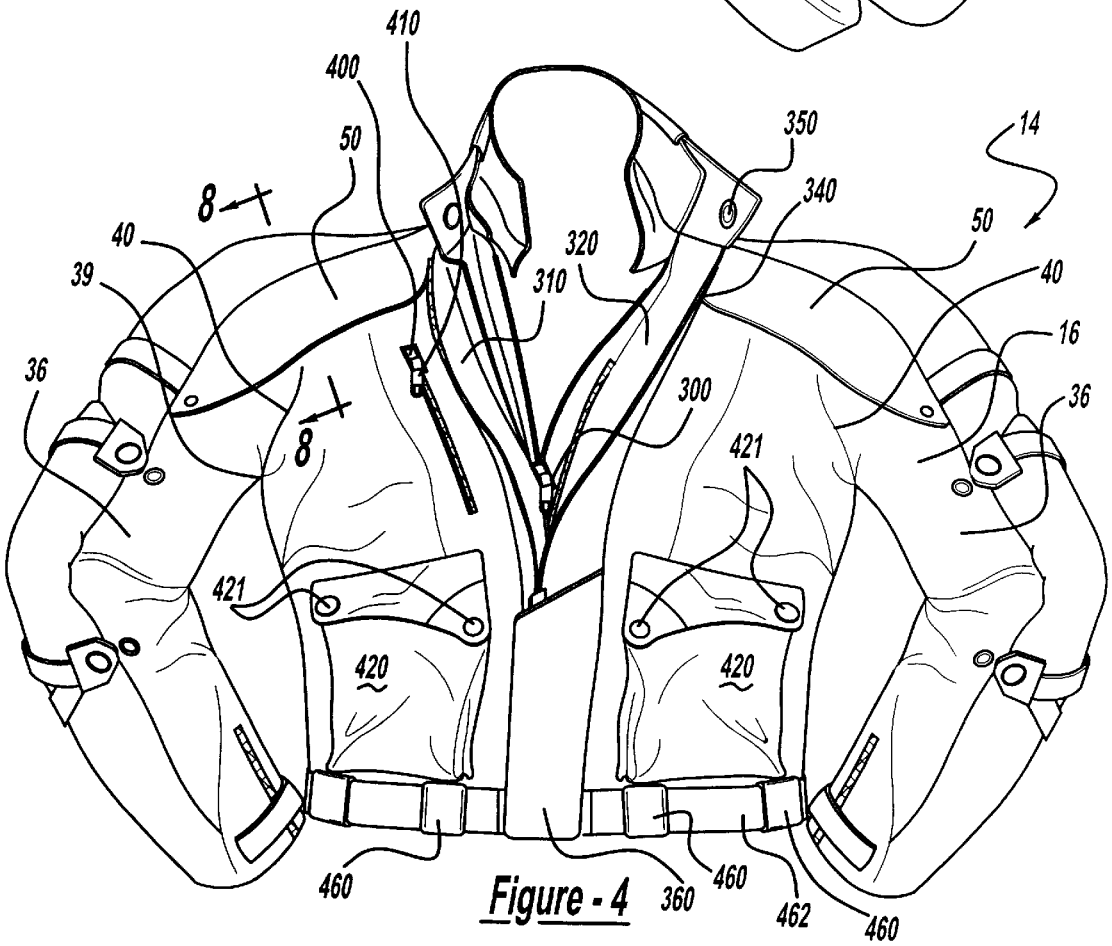
FIG. 4 is a front view of the preferred embodiment garment showing the front vents in closed orientations.
Figure 5:
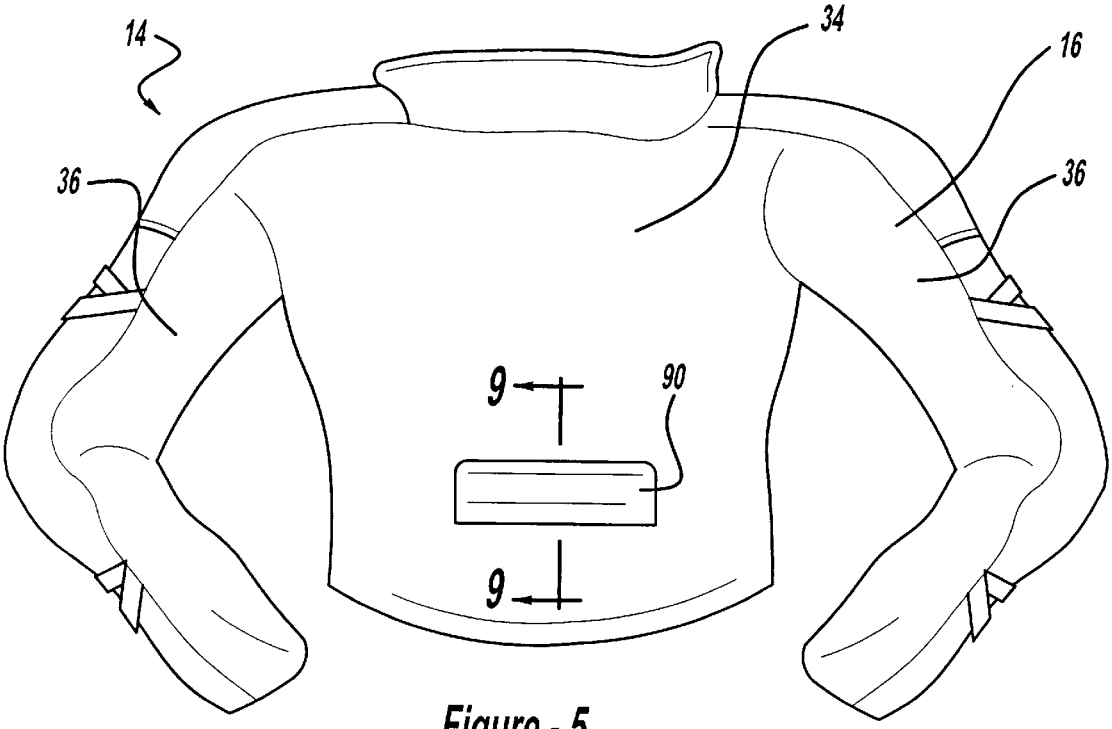
FIG. 5 is a back view of the preferred embodiment garment showing a back vent in a closed orientation.

As shown in FIGS. 2, 4, and 5, shell 16 and mid-liner 18 include a torso portion 30 that is divided into two front parts, 30(*a*) and 30(*b*), by an opening 32. Opening 32 is closed by a full-length plastic primary zipper 300 to allow the wearer to access or remove the jacket with ease. A first flap 310 overlaying the primary zipper 300 is provided. The first flap 310 extends to the full length of the primary zipper 300. The preferred embodiment of garment 14 also includes a second flap 320 overlapping first flap 310 and primary zipper 300. Second flap 320 extends to about two-thirds the length of the primary zipper. Second flap 320 is closed by a secondary zipper 340. Secondary zipper 340 is of the same length as second flap 320. The upper end of first flap 310 and second flap 320 are secured together with the help of snap buttons 350. A third flap 360 is attached below second flap 320. A part of third flap 360 overlays secondary zipper 340 and extends to the end of primary zipper 300. The third flap is closed and secured by snap buttons. Vertically extending pockets (not shown in FIGS.) are provided adjacent primary zipper 300 and beneath first flap 310 and second flap 320. These pockets are closed by zipper mechanisms. Adjacent first flap 310, a vertically extending pocket 400 is provided on outer shell 16. Pocket 400 is closed by a metallic zipper attachment 410. Torso portion 30 of outer shell 16 also includes horizontal pockets 420, which are sealed and secured by snap buttons 421.

Outer shell 16 and mid-liner 18 also each include a back portion 34 and sleeve portions 36, comprising right and left sleeves. A seam 40 is sewn between torso portion 30 and each sleeve portions 36 around an armpit 39. The garment is also provided with removably attached protective pads at the shoulder 44, elbow 45, and back 46. Protective pads 44 and 45 are inserted inside pockets 47 and 48 respectively, which are closed and secured by hook and loop fasteners provided on shell 16. Shoulder and elbow protective pads 44 and 45 include a molded three-dimensional and generally rigid plastic member sewn to a foam-backed fabric pad. Back protective pad 46 is made of flexible, yet stiff, foam material and is inserted inside a pocket 49, secured by a zipper formed on mid-liner 18. The lower end of the shell 16 is provided with loops 460 that are secured to shell 16 with the help of rivets. A belt 462 comprising a hook and loop fastener is provided. Belt 462 is inserted through loop 460 to enable tightening of the jacket 14 around the waist of the rider 10.

Referring to FIGS. 2, 4, 6, and 7, in order to provide ventilation for the rider in hot weather conditions, outer shell 16 is provided with a vent 50 located on each front part 30(*a*) and 30(*b*) of torso portion 30 to allow front entry of air. A vent 90 is located in the back portion 34 of the outer shell 16 to allow air to exit the back of the garment.

As can be observed from FIGS. 2, 3, and 4, each front vent 50 runs diagonally from the torso portion 30 to an upper part of sleeve portion 36 across the seam 39 between the torso portion 30 and the sleeve portion 36. Vent opening 51 is created by cutting shell 16 to define a gap 52. In order to deter insects and small stones from entering the garment and hold together the opening, a stretchable mesh material 54 is sewn across opening 51. The hole size of mesh material 54 is approximately one-sixteenth of an inch in diameter. A zipper type closure mechanism 56 is sewn to fabric edges of shell 16 adjacent to gap 52 to prevent air from entering the garment. Thus, closing closure mechanism 56 can close gap 52.

Rain protection flaps 60 and 61 are provided at vent 50 to prevent moisture from entering the garment. Upper flap 60 is disposed above gap 52. A lower flap 61 is disposed below gap 52. Upper flap 60 extends outwardly from the shell and is parallel to the length of vent opening 51. The lower end of upper flap 60 is stitched above vent opening 51. The side edges of flap 60 are attached to shell 16 with the help of rivets (not shown). Upper flap 60 can be folded back on itself when it is desirable to keep vent opening 51 open. To facilitate the self-folding of upper flap 60, an underside 62 of upper flap 60 has a hook and loop fastener 64.

In addition, upper flap 60 can be deformed from a flat position to a curved or bow-like position to ensure that vent opening 51 is not covered in windy conditions or during high speed use. To enable upper flap 60 remain in a bow-like position, a metallic strip 80 is inserted inside upper flap 60. The metallic strip is held in place with the help of rivets that are inserted from underside 62 of upper flap 60. The rivets are inserted such that the head of the rivet is not visible on the outer side of upper flap 60. Deformable strip 80 is made of a metallic material such as copper with a Polyvinyl Chloride (PVC) coating.

Figure 8:
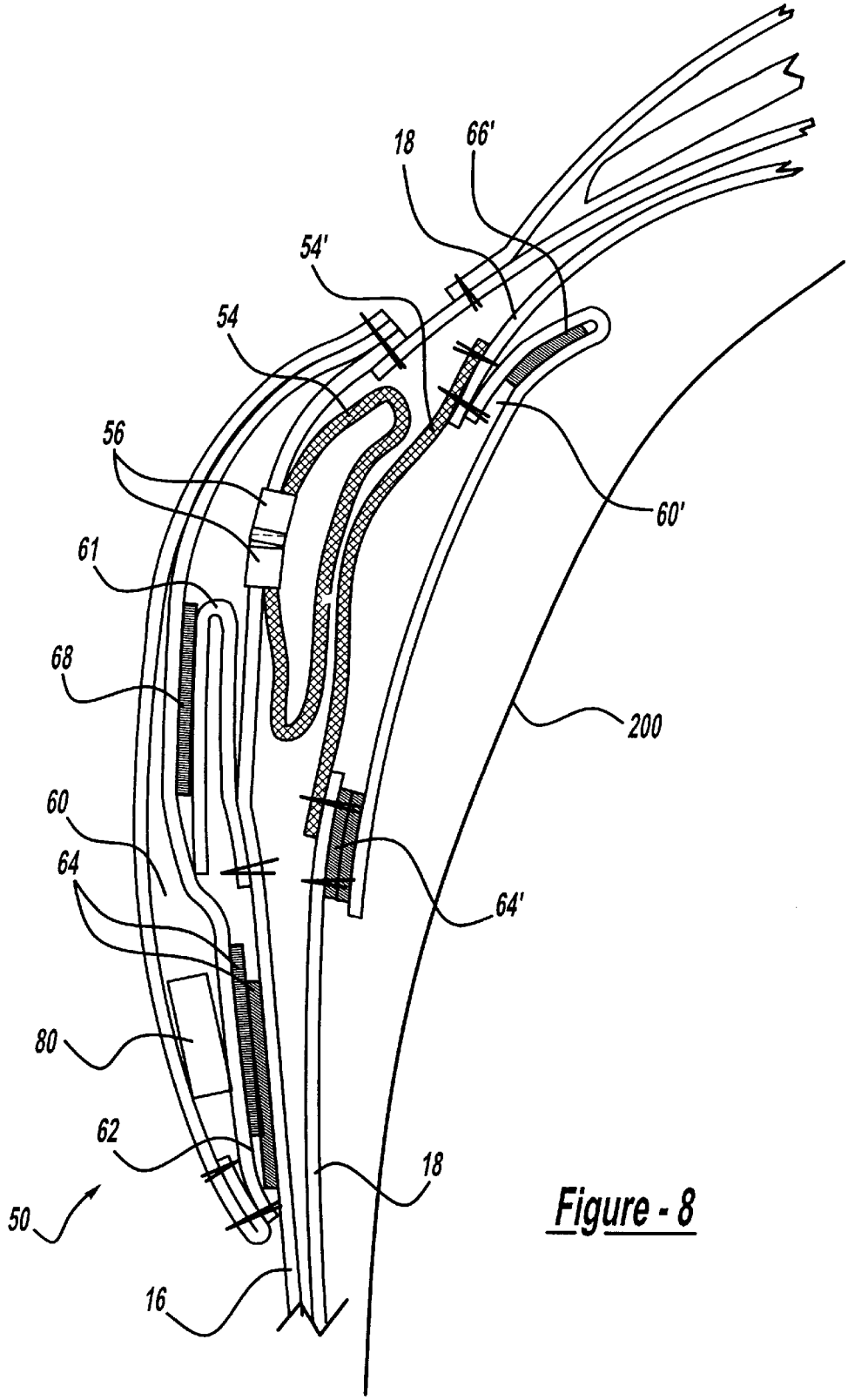
FIG. 8 is a cross-sectional view, taken along line 8—8 of FIG. 4, showing the present invention garment with the front vent disposed in the closed orientation.

A lower flap 61 is located below vent opening 51. Lower flap 61 is substantially folded back on itself. A pocket 68 is formed between closure mechanism 56 and lower flap 61. In addition, lower flap 61 is stitched to shell 16 at one end 70. The opposite end of the lower flap has a slanting end 72. Slanting end 72 prevents water being trapped in pocket 68. In bad weather conditions, when it is desirable to keep the vent opening in a closed position, upper flap 60 is unfolded and fastened to a fastener 66 provided below the lower flap 61. As shown in FIG. 8, when the vent opening is in a closed position, upper flap 60 substantially covers closure mechanism 56 and lower flap 61, while fastening to a fastener 66 located below lower flap 61.

A vent opening 51' is created on mid-liner 18. Vent opening 51, located on shell 16, and vent opening 51' located on the mid-liner 18, coordinate with each other such that any air entering vent opening 51 reaches body 200 of the rider by passing through vent opening 51'. Vent opening 51' defines a gap 52'. In order to deter insects and small stones from entering the garment and hold together the opening, a stretchable mesh material 54' is sewn across opening 51'. An upper flap 60' is located above vent opening 51', extends outwardly from mid-liner 18, and is parallel to the length of vent opening 51'. The upper flap 60' can be folded back on itself when it is desirable to keep vent opening 51' open. To facilitate the self-folding of the upper flap 60', an underside 62'of upper flap 60' has a hook and loop fastener 64'. As described below, when it is desirable to cover vent opening 51', flap 60' can be unfolded from its self-folding position and fastened to a fastener 66' located below vent opening 51'.

Figure 9:
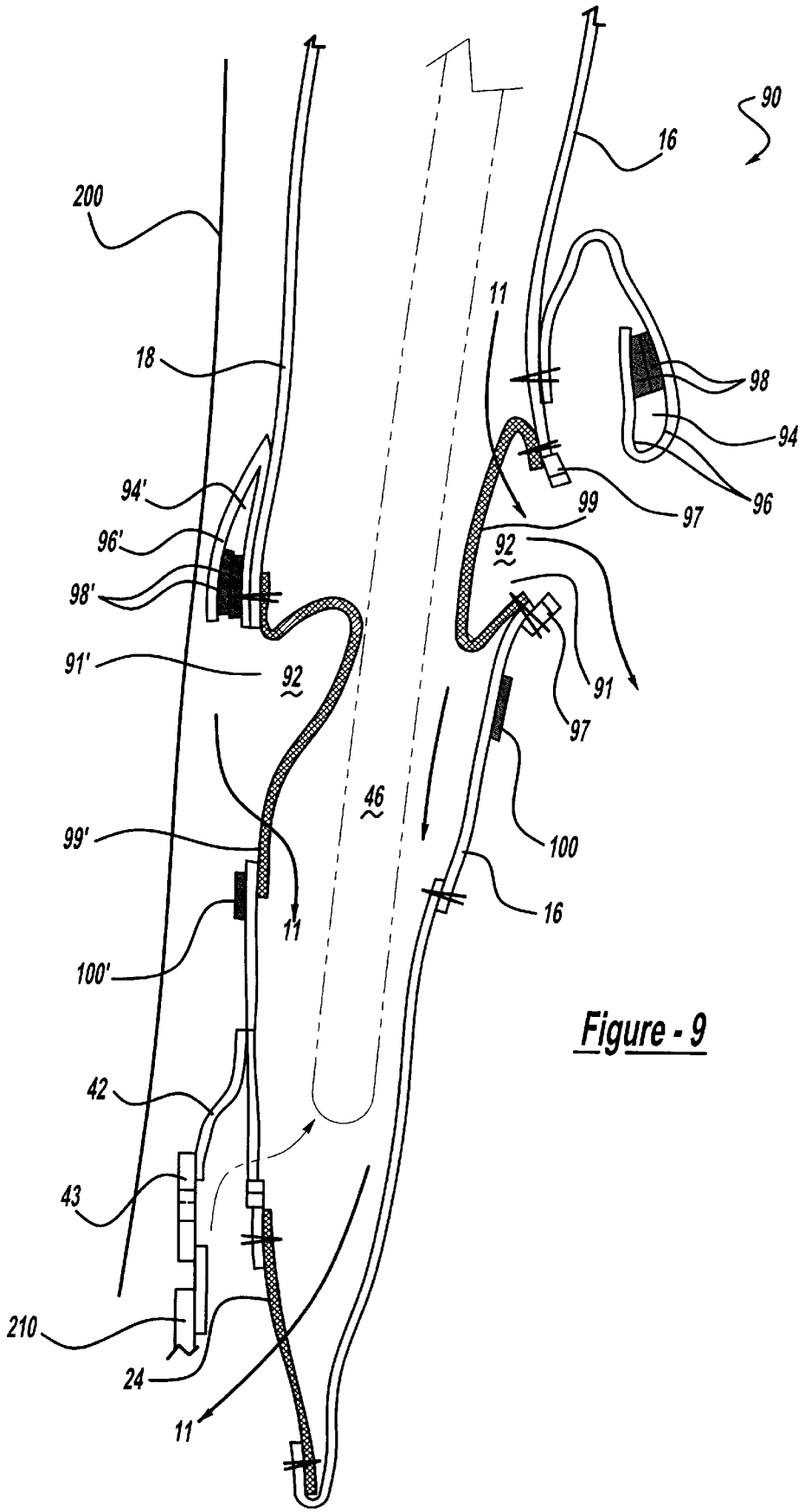
FIG. 9 is a cross-sectional view, taken along line 9—9 of FIG. 5, showing the present invention garment with back vents disposed in open orientations.

As best shown in FIGS. 2 and 9, a second vent 90 is created at back portion 34 of ventilating garment 14. A back vent opening 91 defines a gap 92. A stretchable mesh material 99 is sewn across opening 91. A zipper type closure mechanism 97 is sewn to fabric edges of shell 16 adjacent to gap 92 for preventing air from entering the garment. Thus, closing closure mechanism 97 can close gap 92. Further, vent opening 91 has a rain protection flap 94 to prevent moisture from entering the garment. Flap 94 is disposed above gap 92. Flap 94 extends outwardly from the shell and is parallel to the length of vent opening 91. The lower end of upper flap 94 is stitched above vent opening 91. When it is desirable to keep vent opening 91 open, upper flap 94 may be folded back on itself such that it is not covering gap 92. An underside 96 of upper flap 94 has a hook and loop fastener 98 to facilitate the self-folding of upper flap 94. In bad weather conditions, when it is desirable to close vent opening 91, flap 94 is unfolded and fastened to a fastener 100 located below vent opening 91.

A vent opening 91' coordinating with vent opening 91 is created on mid-liner 18 at the back portion 34. In order to deter insects and small stones from entering the garment and hold together the opening, a stretchable mesh material 99' is sewn across opening 91'. An upper flap 94' located above vent opening 91', extends outwardly from mid-liner 18, and is parallel to the length of vent opening 91'. The upper flap 94' can be folded back on itself when it is desirable to keep vent opening 91' open. To facilitate the self-folding of the upper flap 94', an underside 96'of upper flap 94' has a hook and loop fastener 100'.

FIGS. 2 and 9 illustrate a fabric flap 42, the upper edge of which is centrally sewn to back portion 34 of mid-liner 18. This flap has a plastic zipper on its lower edge. A removable tab 43 with a mating zipper can fasten the rider's pants 210 to ensure that the pants stays in place relative to the jacket for preventing exposure to the elements at the lower body when the rider is leaning forward.

Figure 7:
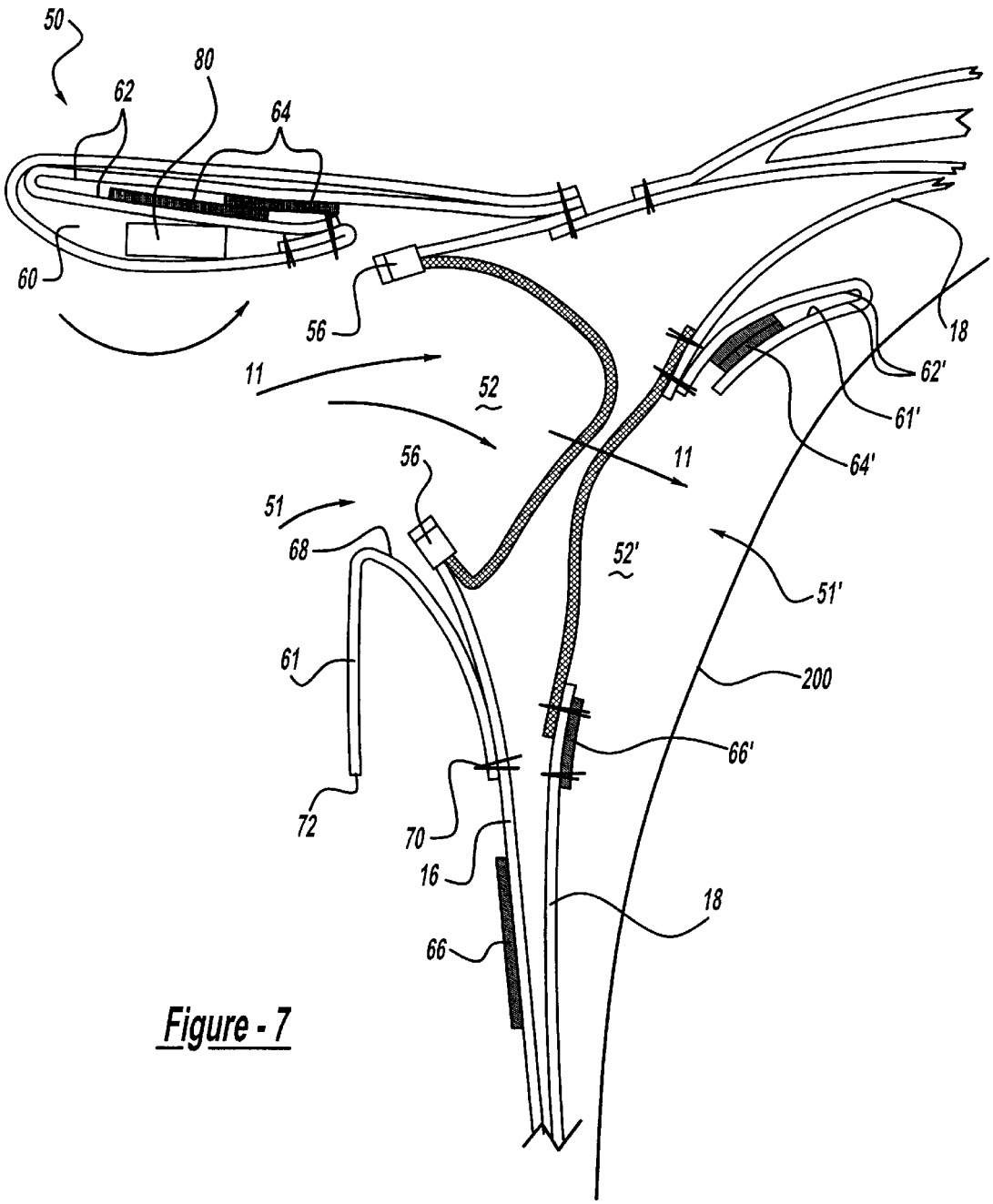
FIG. 7 is a cross-sectional view, taken along line 7—7 of FIG. 6, showing the present invention garment with the front vent disposed in the open orientation.

As in FIGS. 7 and 9, the air ventilation is provided by vents 50 and 90 located on torso portion 30 and back portion 34 respectively. Vents 50 and 90 help the air reach body 200, thereby cooling body 200 of rider 10. The ventilating garment provides for air 11 to enter vent opening 51, 51', and exit through ventilating opening 91. Air 11 may also exit through mesh material 24 provided on the lower end of mid-liner 18.

Figure 6:
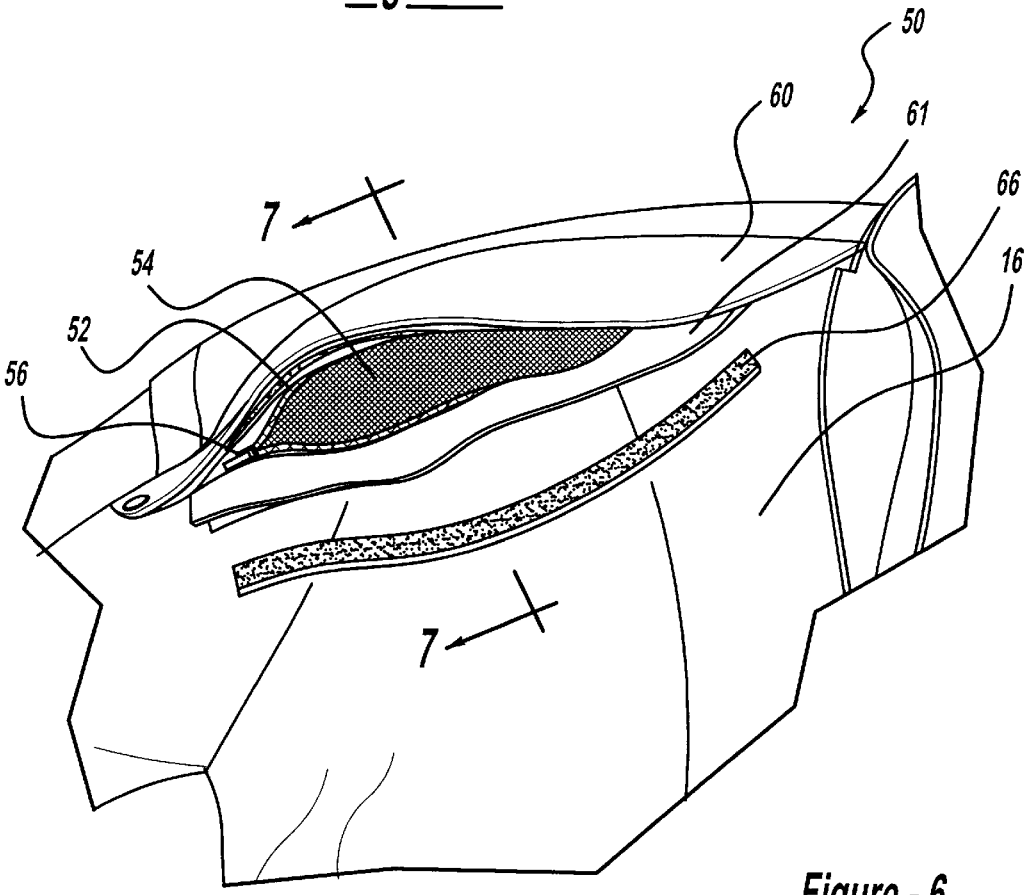
FIG. 6 is an enlarged front view of the preferred embodiment garment showing a front vent in an open orientation.

As best shown in FIGS. 6 and 7, in hot weather conditions, vent openings 51 will be in an open position, thereby allowing air 11 to flow through gap 52. When vent opening 51 is in an open position, flap 60 is folded back. Upper flap 60 is deformed to a bow-like position such that it does not cover vent opening 51. Similarly, upper flap 64', located on the mid-liner 18, is folded back on itself when vent opening 51 is in an open position. As best shown in FIG. 8, in cold or rainy bad weather conditions or when it is not desirable to keep the vent opening in an open position, vent opening 51 will be closed by closing closure mechanism 56, thereby preventing any air or water from entering the garment. When vent opening 51 is in a closed position, upper flap 60 is unfolded and is fastened to a fastener 66 located on shell 16. Flap 60 also substantially covers the zipper type closure mechanisms 56 and lower flap 61. Therefore, in wet weather conditions, flap 60 will prevent any moisture or air from entering through the closure mechanism. Similarly, upper flap 60' on mid-liner 18 is unfolded and is fastened to a fastener 66'located below vent opening 51', thereby closing vent opening 51'. Vent opening 91 located on back portion 34 can be closed or opened by operating the closure mechanism 97, to allow or prevent air from entering the garment. Airflow 11 entering garment 14 can be controlled by selectively opening or closing vents 50 and 90. For example, vent 50 may be open and vent 90 may be in a closed position. In such a situation, the air entering the garment will exit through the mesh material 24. It is also possible to control the inflow of air by partially opening vents 50 and 90.

While the preferred embodiment of a ventilating garment has been disclosed herein, it should be appreciated that other embodiments may be employed without departing from the present invention. For example, the preferred copper deformable strip may be replaced by other generally deformable materials such as aluminum wires or a shapeable polymer. Also, the deformable material may not be coated with PVC or may be placed on an outside surface of a flap. The deformable material may also be present in the upper flap on the mid-liner or back venting flap. In the preferred embodiment, it is depicted that the vent opening located in the back portion is horizontally placed. Alternatively, it is possible to have a vertical or diagonal back vent openings. It is further envisioned that the present invention garment can be a racing pant and jacket suit combination, a vest, a raincoat, a sweatshirt, or the like. Furthermore, heat welding or adhesive bonding can alternatively be used in place of or in addition to sewing. Waterproof, taped seams can also be used in place of a mid-liner. The bottom flap of the front or rear vents may also employ deformable members. In the preferred embodiment, it is depicted that the front opening has three overlapping flaps. It is possible to have single overlapping flap. Furthermore, the secondary zipper in the front opening may extend to the full length of the primary zipper. While various materials have been disclosed, it should be appreciated that alternate materials may be employed. It is intended by the following claims to cover these and any other departures from the disclosed embodiments, which fall within the true spirit of this invention.

The invention claimed is:

1. A ventilating garment comprising:

an outer shell layer;

an internal layer internally attached to the shell layer;

a first vent opening located on the shell layer;

a second vent opening located on the internal layer, air operably being allowed to flow from the first vent opening to the second vent opening;

a closure operably moveable to a first position to deter air from entering the first vent opening, the closure being operably moveable to a second position to allow air to enter the first vent opening;

a first flap disposed on a first side of the first vent opening;

a deformable material attached to the first flap such that the first flap is deformable from a first orientation to a second orientation, the second orientation allowing open access to the first vent opening; and a second flap disposed on a second side of the first vent opening substantially opposite the first side, wherein the flaps define a labyrinth when closed.

2. The ventilating garment of claim 1 her comprising a first fastener attached to an underside of the first flap, first flap being moveable to a folded back position and removeably fastenable to the first fastener when it is desired to allow air entry through the first vent opening.

3. The ventilating garment of claim 2 wherein the fastener is a hook and loop fastener.

4. The ventilating garment of claim 1 further comprising a second fastener attached to the shell adjacent the second flap, the first flap moveable to cover the closure, cover the first vent opening and removeably fasten to the second fastener when it is desired to deter air entry through the first vent opening.

5. The ventilating garment of claim 4 wherein the second fastener is a hook and loop fastener.

6. The ventilating garment of claim 1 wherein the deformable material is copper.

7. The ventilating garment of claim 6 wherein the copper has a PVC coating.

8. The ventilating garment of claim 1 wherein the closure is a zipper.

9. The ventilating garment of claim 1 wherein the deformable material is a metal member positioned inside the first flap.

10. The ventilating garment of claim 1 wherein a mesh material is a attached behind the closure.

11. The ventilating garment of claim 1 further comprising a substantially rigid and removable inserts located at the elbow and shoulder portions of the shell.

12. A ventilating garment comprising:

an outer shell having a front torso portion and sleeve portion joined at the seam;

a first vent opening located on the shell positioned on the front portion and extending on to the sleeve portion across the seam, wherein movement of the sleeve portion relative to the front torso portion will encourage accessibility to the first vent opening;

a mid-liner layer internally attached to the shell; and a second vent opening located on the mid-liner and air operably being allowed to flow from the first vent opening to the second vent opening.

13. The ventilating garment of claim 12 further comprising an upper flap located above the first vent opening.

14. The ventilating garment of claim 13 further comprising a deformable material attached to the upper flap such that the upper flap is deformable from a first orientation to a second orientation, the second orientation being allowing open access to the first vent opening.

15. The ventilating garment of claim 14 wherein the deformable material is copper.

16. The ventilating garment of claim 15 wherein the copper has a PVC coating.

17. The ventilating garment of claim 12 further comprising a closure operably moveable to a first position to deter air from entering the first vent opening, the closure being operably moveable to a second position to allow air to enter the first vent opening.

18. The ventilating garment of claim 17 wherein the closure is a zipper.

19. The ventilating garment of claim 12 further comprising a lower flap disposed below the first vent opening.

20. A ventilating garment comprising:

an outer shell having a front torso portion, a sleeve portion joined at a seam to the front torso portion and a back portion;

a first vent opening located on the shell and positioned on the front portion extending on to the sleeve portion across the seam;

a second vent opening located on the shell and positioned substantially horizontally on the back portion of the shell;

a closure operably moveable to a first position to deter air from entering at least one of the first and second vent openings, the closure being operably moveable to a second position to allow air to enter at least one of the first and the second vent openings;

a first flap located adjacent to one of the vent openings; and a fastener located on an underside of the first flap, the first flap being foldable back upon itself and fastenable to the fastener.

21. The ventilating garment of claim 20 further comprising a second flap located adjacent to the second vent opening.

22. The ventilating garment of claim 21 further comprising a deformable material attached to the first flap such that the first flap is deformable from a first orientation to a second orientation, the second orientation allowing open access to the first vent opening.

23. The ventilating garment of claim 22 wherein the deformable material is metal with a PVC coating.

24. The ventilating garment of claim 21 further comprising a second fastener located on an underside of the second flap which is an upper flap, the second flap being foldable and fastenable to the second fastener.

25. The ventilating garment of claim 20 further comprising a mid-liner internally attached to the shell.

26. A ventilating garment comprising:

an outer shell layer;

a first vent opening located on the shell;

a moveable first flap disposed adjacent the first vent opening; and a deformable material attached to the first flap such that the first flap is deformable from a first orientation to a second orientation, the second orientation allowing open access to the first vent opening.

27. The ventilating garment of claim 26 further comprising a mid-liner internally attached to the shell layer.

28. The ventilating garment of claim 27 further comprising a second vent opening located on the mid-liner, air operably being allowed to flow from the first vent opening to the second vent opening.

29. The ventilating garment of claim 28 wherein the first and the second vent openings are positioned on a front portion of the shell extending to a sleeve portion across a seam between the front portion and the sleeve portion.

30. The ventilating garment of claim 29 wherein the first and the second vent openings are positioned on a back portion of the shell.

31. The ventilating garment of claim 26 further comprising a closure operably moveable to a first position to deter air from entering the first vent opening, the closure being operably moveable to a second position to allow air to enter the first vent opening.

32. The ventilating garment of claim 31 further comprising a mesh material attached behind the closure.

33. The ventilating garment of claim 32 wherein the closure is a zipper.

34. The ventilating garment of claim 26 wherein the deformable material is metal with PVC coating and is located inside the first flap.

35. The ventilating garment of claim 34 wherein the metal is copper.

36. A ventilating jacket comprising:

an outer shell layer;

a mid-liner internally attached to the shell layer;

a first vent opening located on the shell layer;

a second vent opening located on the mid-liner layer, air operably being allowed to flow from first vent opening to the second vent opening, wherein the first and the second vent opening are positioned on a front portion of the garment extending to a sleeve portion across a seam between the front portion and the sleeve portion and are also positioned horizontally in a back portion of the garment;

a first upper flap located above the first vent opening;

a deformable material attached to the first upper flap such that the first upper flap is deformable from a first orientation to a second orientation, the second orientation allowing open access to the first vent opening;

a second upper flap located above the second vent opening;

a lower flap located below the first vent opening, wherein the first upper flap and the lower flaps define a labyrinth when closed; and a closure operably moveable to a first position to deter air from entering the first vent opening, the closure being operably moveable to a second position to allow air to enter the first vent opening.

37. The ventilating garment of claim 36 further comprising:

substantially rigid and removable inserts located at an elbow and a shoulder portion of the shell;

a substantially rigid and removable foam insert located at the back portion of the mid-liner;

a fastener located adjacent to the second vent opening on the mid-liner to fasten the jacket to an external garment; and a mesh material stitched at a lower end of the mid-liner to allow air to exit.

38. A method of providing ventilation in a jacket comprising the steps of:

(a) opening a vent opening;

(b) deforming at least an intermediate portion of a flap upward and maintaining the intermediate portion of the flap in an open and substantially free standing position such that it does not substantially cover the vent opening; and (c) allowing air to enter the jacket through the vent opening after steps (a) and (b).

39. A method of providing ventilation in a jacket comprising the steps of:

(a) opening a vent opening;

(b) deforming a flap to maintain the flap in an open position such that it does not substantially obstruct the vent opening;

(c) allowing air to enter the jacket through the vent opening after steps (a) and (b); and (d) folding back a flap and fastening the flap to a fastener provided under the flap.

* * * * *

UNITED STATES PATENT AND TRADEMARK OFFICE

CERTIFICATE OF CORRECTION

PATENT NO. : 6,263,510 B1
APPLICATION NO. : 09/573802
DATED : July 24, 2001
INVENTOR(S) : Bay et al.

It is certified that error appears in the above-identified patent and that said Letters Patent is hereby corrected as shown below:

Title Page, item (57) Abstract, line 8 “a” should be --an--.

Column 4, line 10, after “60” insert --to--.

Column 5, line 16, “stays” should be --stay--.

Column 6, line 11, after “have” insert --a--.

Column 6, line 39, Claim 2, “her” should be --further--.

Column 6, line 64, Claim 10, after “material is” delete “a”.

Column 6, line 66, Claim 11, “inserts” should be --insert--.

Column 7, line 18, Claim 14, delete “being”.

Signed and Sealed this

Fourth Day of March, 2008

JON W. DUDAS
*Director of the United States Patent and Trademark Office*